US009233046B2

(12) United States Patent
Matjacic et al.

(10) Patent No.: US 9,233,046 B2
(45) Date of Patent: Jan. 12, 2016

(54) UNIVERSAL HAPTIC DRIVE SYSTEM

(75) Inventors: Zlatko Matjacic, Ljubljana (SI); Imre Cikajlo, Ljubljani (SI); Jakob Oblak, Straza (SI)

(73) Assignee: Fundacion Fatronik, San Sebastian (ES)

( * ) Notice: Subject to any disclaimer, the term of this patent is extended or adjusted under 35 U.S.C. 154(b) by 1079 days.

(21) Appl. No.: 13/123,557

(22) PCT Filed: Oct. 10, 2008

(86) PCT No.: PCT/EP2008/063636

§ 371 (c)(1),
(2), (4) Date: May 31, 2011

(87) PCT Pub. No.: WO2010/040416

PCT Pub. Date: Apr. 15, 2010

(65) Prior Publication Data

US 2011/0264018 A1 Oct. 27, 2011

(51) Int. Cl.
*A61H 1/02* (2006.01)

(52) U.S. Cl.
CPC ..... *A61H 1/0274* (2013.01); *A61H 1/0277* (2013.01); *A61H 1/0285* (2013.01); *A61H 2201/5061* (2013.01)

(58) Field of Classification Search
CPC ..... A61H 1/00; A61H 1/02; A61H 1/0274; A63B 23/035; A63B 23/03508; A63B 23/0355; G06F 3/016
USPC ..... 601/5, 33, 40; 482/44, 45, 46
See application file for complete search history.

(56) References Cited

U.S. PATENT DOCUMENTS

| | | | | |
|---|---|---|---|---|
| 2,898,068 | A * | 8/1959 | Warren | 248/183.1 |
| 5,118,058 | A * | 6/1992 | Richter | 248/183.2 |
| 5,193,963 | A | 3/1993 | McAffee | 414/5 |
| 5,228,356 | A * | 7/1993 | Chuang | 74/471 XY |
| 5,587,937 | A * | 12/1996 | Massie et al. | 703/7 |
| 5,631,861 | A * | 5/1997 | Kramer | B25J 13/02 414/5 |
| 5,738,636 | A * | 4/1998 | Saringer et al. | 601/5 |
| 5,755,645 | A | 5/1998 | Miller et al. | 482/115 |
| 6,435,186 | B1 * | 8/2002 | Klemm | 128/845 |
| 8,010,180 | B2 * | 8/2011 | Quaid et al. | 600/424 |
| 2002/0094913 | A1 | 7/2002 | Valentino | 482/45 |

(Continued)

FOREIGN PATENT DOCUMENTS

WO 2005/074371 8/2005

OTHER PUBLICATIONS

H. Krebs et al., "Robotic Rehabilitation Therapy", *Wiley Encyclopedia of Biomedical Engineering*, pp. 1-19 (2006).

(Continued)

*Primary Examiner* — Justine Yu
*Assistant Examiner* — Christopher Miller
(74) *Attorney, Agent, or Firm* — Ostrolenk Faber LLP

(57) ABSTRACT

A universal haptic drive system for arm and wrist rehabilitation that includes a hand accessory and a vertical handle for carrying the hand accessory, the vertical handle being movable in a transversal plane. The system furthermore includes a haptic actuator system for applying a force to the vertical handle. The vertical handle includes a universal joint with locking ability. When the universal joint is unlocked, it enables movements for wrist rehabilitation, and when it is locked it causes a stiff substantially vertical handle enabling movements for arm rehabilitation.

16 Claims, 8 Drawing Sheets

(56) References Cited

U.S. PATENT DOCUMENTS

| | | | | |
|---|---|---|---|---|
| 2004/0243027 | A1 | 12/2004 | Hook | 601/33 |
| 2006/0033707 | A1* | 2/2006 | Rodomista et al. | 345/156 |
| 2006/0106326 | A1 | 5/2006 | Krebs et al. | 601/40 |
| 2007/0282228 | A1* | 12/2007 | Einav et al. | 601/33 |
| 2008/0000317 | A1* | 1/2008 | Patton et al. | 74/500.5 |
| 2008/0291161 | A1* | 11/2008 | Massie et al. | 345/156 |
| 2010/0016766 | A1* | 1/2010 | Zhang et al. | 601/5 |

OTHER PUBLICATIONS

S. Hesse et al., "Upper and lower extremity robotic devices for rehabilitation and for studying motor control", *Robotic devices for rehabilitation and studying motor control*, pp. 705-709.
International Search Report dated Mar. 5, 2009.

* cited by examiner

UNIVERSAL HAPTIC DRIVE SYSTEM

CROSS REFERENCE TO RELATED APPLICATIONS

The present application is a 35 U.S.C. §371 National Phase conversion of PCT/EP2008/063636, filed Oct. 10, 2008, the disclosure of which is incorporated herein by reference. The PCT International Application was published in the English language.

BACKGROUND OF THE INVENTION

1. Technical Field

The present invention relates to a universal haptic drive system for arm and wrist rehabilitation.

2. Description of Related Art

Upper extremity function is of paramount importance to carry out various activities of daily living. Various neurological diseases, most notably stroke, as well as orthopaedic conditions result in impaired function of manipulating various objects by reaching, orienting and grasping activities. Reaching or approaching toward an object is done by shoulder and elbow, orienting of and object is accomplished by wrist, while grasping and releasing of an object is carried out by opening and closing a hand.

After an injury or neurological impairment intensive physiotherapy is employed through active-assisted targeted movement and exercises aiming at restoration of sensory-motor planning, reduction of spasticity and preservation of range of motion to facilitate recovery of the arm and hand functionality. Numerous clinical studies have shown that a key to successful recovery is a sufficient number of repetitions that relate to a practiced task. Here two basic approaches can be distinguished: complex movement practice that involves reaching, orienting and grasping activities combined in a single task and isolated well-defined specific movement training of each isolated component of upper extremity function. Training specificity determines also therapy outcome; i.e. reaching exercises activate shoulder and elbow thus resulting in improvement of transport of the hand toward target location; movement of forearm and wrist exercises that serve to orient the hand and provide stability and control during grasping result in improvement of wrist function, while grasping and releasing exercises result in improvement of grasping function. The above outlined movement practice is facilitated by a physiotherapist that employs verbal communication as well as physical interaction to guide a trainee to appropriately execute a given task.

Rehabilitation robotics seems to be particularly well suited for delivery of mass-practiced movement. It brings precision, accuracy and repeatability and combined with computer or virtual reality tasks provide stimulating training environment. Impedance control of rehabilitation robots enables programmable haptic interaction with the paretic arm and hand. Such a haptic interaction is needed to initiate, guide and halt movement depending on the activity of the user. It has been demonstrated in numerous clinical studies that these features of rehabilitation robots yield significant rehabilitation results.

The current state of the art includes haptic robotic solutions that have from one to three haptic degrees of freedom and were developed for training of the shoulder and elbow. Examples are MIT-MANUS described in U.S. Pat. No. 5,466,213 (Hogan et al.), and ARM Guide and EMUL described in an article by Krebs et al., Robotic rehabilitation therapy, Wiley encyclopaedia of Biomedical Engineering, John Wiley & Sons, 2006. Other robotic solutions were developed for wrist, such as BI-MANU-TRACK, described by Hesse et al., Upper and lower extremity robotic devices for rehabilitation and studying motor control, Current Opinion in Neurology 2003, 16: 705-710 and MIT wrist robot described in the earlier cited article by Krebs et al. MIT-MANUS is a two-degrees-of-freedom, SCARA-type, planar impedance controlled robot that enables practicing of reaching movement in horizontal plane by activating shoulder and elbow. With MIT-MANUS it is not possible to practice movement along the vertical axis. EMUL is a three-degrees-of-freedom, PUMA type, impedance controlled robot that enables practicing reaching movement of the arm within the whole workspace, including the vertical axis. ARM Guide on the other hand is a single degree-of-freedom impedance controlled robot that enables movement of the arm (shoulder and elbow) along the line and can be oriented in different directions within the 3D workspace to enable practicing of reaching movement in different parts of a workspace. BI-MANU-TRACK is a device that offers active (motor assisted) or passive training of wrist flexion/extension or (depending on the mechanical configuration of the device) forearm pro/supination following bi-lateral approach, meaning that the un-impaired side drives movement of impaired side in a mirror-like or parallel fashion. MIT wrist robot is a three-degrees-of-freedom device that has three impedance controlled axis that intersect with all three human wrist degrees-of-freedom (flexion/extension, abduction/adduction and pronation/supination) enabling simultaneous practicing of wrist orientation movement. The common denominator for the above devices is that for exhibiting compliant (impedance controlled) performance the actuated degrees of freedom need to be back-drivable, meaning that the inherent impedance of actuators must be low. This necessitates use of direct drive, high torque motors as well as use of precise position and force sensors. Another drawback of the known devices is that they provide training environment for only one component/activity of reaching movement, either reaching movement or wrist movement.

SUMMARY OF THE INVENTION

It is an object of the invention to provide a universal haptic drive system that allows for easy and rapid transformation of a reaching movement rehabilitation robot into wrist movement rehabilitation robot.

Thereto, according to an aspect of the invention a universal haptic drive system is provided.

The universal haptic drive system for arm and wrist rehabilitation according to an aspect of the present invention comprises a hand accessory, a substantially vertical handle for carrying the hand accessory, the substantially vertical handle being movable in a transversal plane and a haptic actuator system for applying a force to the substantially vertical handle. The substantially vertical handle comprises a universal joint with locking ability. When the universal joint is unlocked, it enables movements for wrist rehabilitation, and when the universal joint is locked it causes a stiff substantially vertical handle enabling movements for arm rehabilitation.

In this way, the universal haptic drive system can be easily and rapidly transformed from reaching movement rehabilitation robot into wrist movement rehabilitation robot and vice versa, simply by locking and unlocking the universal joint. Thereto the substantially vertical handle may be provided with a brace.

Thus, an inexpensive machine is proposed that enables two haptic degrees of freedom and one passive un-actuated and gravity balanced degree of freedom that can be used for arm and wrist movement training depending on the mechanical configuration.

According to an embodiment of the invention, the haptic actuator system comprises two wire-based actuators each applying a force in a direction substantially perpendicular to the substantially vertical rod in its initial position, the wire-based actuators each comprising an electric motor and elastic force transmission means connected in series thereto, for example a linear spring. According to an embodiment, the wire based actuators each comprise means for sensing a force exercised by a subject and a position, such as detection means for detecting the elongation of the linear spring, for example linear potentiometers. According to a further embodiment the wire-based actuators further comprise elastic means for regulating the tension of a recurrent wire, the elastic means for example being a linear spring. According to a still further embodiment, the wire-based actuators each comprise directional pulleys for ensuring smooth running of the recurrent wire. Furthermore, the wire-based actuators may each further comprises a pulley mounted on the shaft of the electric motor to wind up a wire connected to the elastic force transmission means.

As a result, readily available and inexpensive DC electric motors with geared trains may be used to provide adequate force control and haptic behaviour. The unique mechanical design of the proposed universal haptic drive system enables deriving information for position and force applied to the robot end-effecter from measuring the length of the mechanical springs that are placed between the electric motors and the loading bar or by using a force sensor or both.

These and other aspects of the invention will be apparent from and elucidated with reference to the embodiments described hereinafter.

BRIEF DESCRIPTION OF THE DRAWINGS

The invention will be better understood and its numerous objects and advantages will become more apparent to those skilled in the art by reference to the following drawings, in conjunction with the accompanying specification, in which.

Throughout the figures like reference numerals refer to like elements.

DETAILED DESCRIPTION OF THE PRESENT INVENTION

Referring now to the figures, an exemplary embodiment of universal haptic drive system according to the invention will be described.

Figure 1:
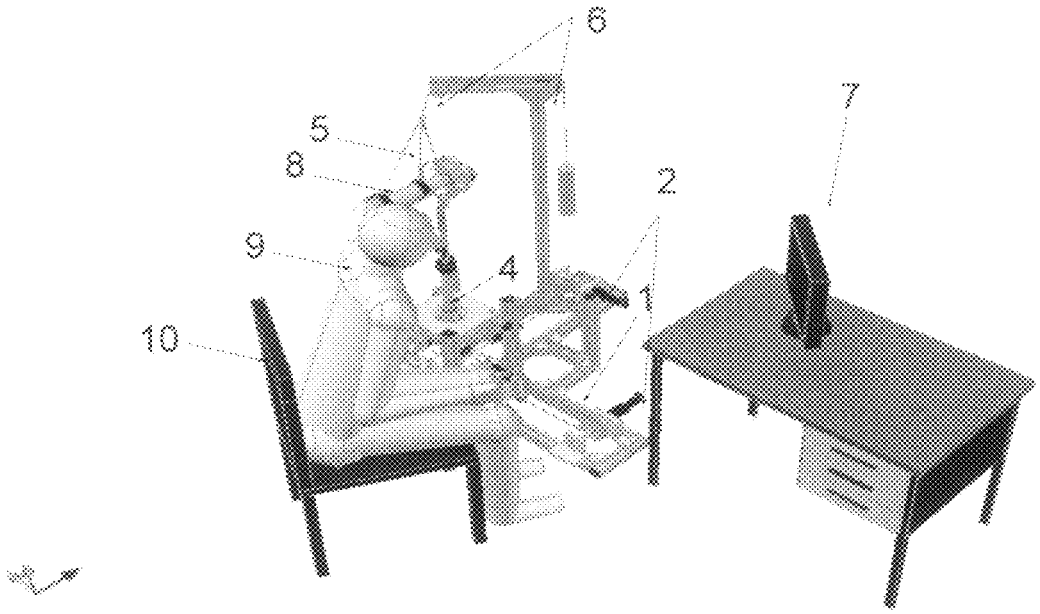
FIG. 1 shows the major components of the universal haptic drive system according to an embodiment of the present invention.

The proposed universal haptic drive system consists of the following major components: an aluminium frame 1, a haptic actuator system comprising two haptic wire-driven actuators 2,3 with two electrical motors with a reduction gear, a substantially vertical handle 4 with a hand accessory 5, an end-effecter weight balance system 6, a visual display 7, an arm holder 8, where the subjects 9 put their arm 9.1 (FIG. 9) and a chair 10 (a place to sit) as shown in FIG. 1. In the context of the present description the term "substantially vertical" should be understood to include directions with an up till 20 degrees deviation with respect to the vertical axis.

The actuators 2,3 each consist of an electric motor 2.1,3.1 with gearbox, pulley 2.2,3.2, linear springs 2.3,2.4,3.3,3.4, a directional pulley 2.5, 3.5, a linear potentiometer 2.6,3.6 and wires 2.7, 2.8, 2.9, 2.10,3.7,3.8,3.10. On the shaft of the electrical motors 2.1,3.1 pulleys 2.2,3.2 are mounted to wind up the wires. The wires 2.10,3.10 fixed to the pulleys 2.2,3.2 are connected via the linear springs 2.3,3.3 to the base of a vertical rod 1.2. The recurrent wires 2.8,3.8 are lead through the directional pulleys 2.5,3.5 and linear springs 2.4,3.4 back 2.9 to the pulleys 2.2,3.2.

The vertical handle 4 is inserted into the vertical rod 1.2 creating a passive linear joint 4.1 and the vertical rod 1.2 is inserted into spherical bearing 1.1, enabling movement in a substantially transversal plane (XZ) with respect to the vertical handle 4 in its initial position. In the context of the present description the term "substantially transversal plane" should be understood to include planes having an up till 20 degrees deviation with respect to the plane that is perpendicular to the vertical handle in its initial position.

Figure 2A:
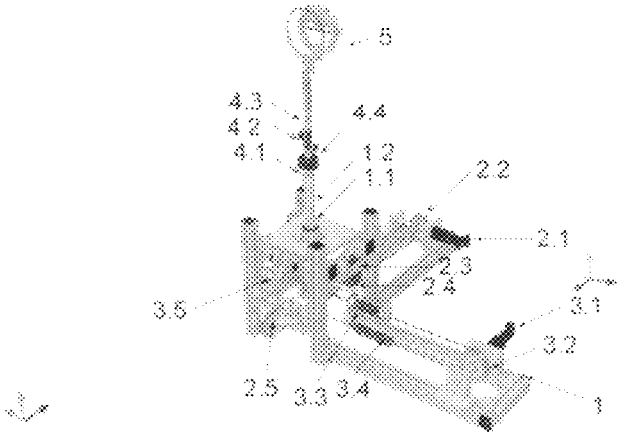
FIG. 2 shows the haptic wire-driven actuators and the hand accessory thereof.
Figure 2B:
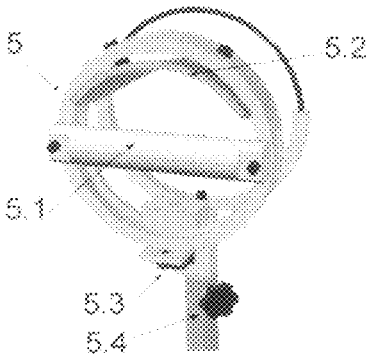

The vertical handle 4 contains a 1 Degree of Freedom (DOF) linear passive joint 4.1, a 2 DOF universal joint 4.3 with locking ability and a force sensor 4.4 and carries the hand accessory 5. The hand accessory 5 consists of a grip 5.1 and a hand shield 5.2. It is mounted to the vertical handle 4 with adjustable screws 5.3,5.4 as shown in FIG. 2 at the right side. The screw 5.3 disables the rotation of the grip 5.1 from its selected position. It should be noted that the location of the force sensor 4.4 is one possible example. It could also be placed directly underneath the hand accessory 5.

Figure 3:
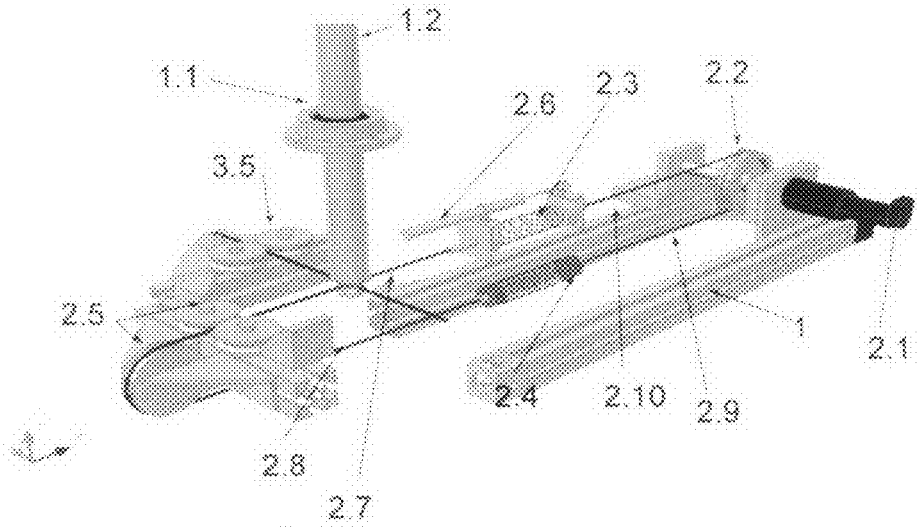
FIG. 3 shows one of the actuators in detail.
Figure 4:
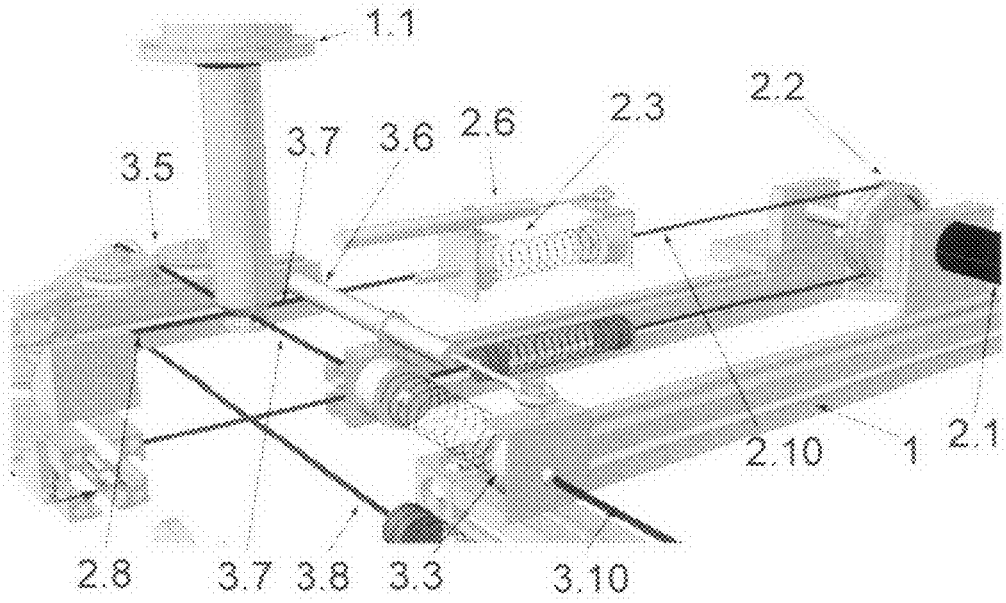
FIG. 4 shows the actuator mechanism for both directions.

FIG. 3 shows one of the actuators. On the shaft of the electric motor 2.1 with the gearbox a pulley 2.2 is fixed and connected with the vertical rod 1.2 with wires. The wire 2.7 connected to the base of the vertical rod 1.2 on one side and linear spring 2.3 on the other side is fixed to the pulley 2.2 by wire 2.10. The recurrent wire 2.8 is lead through the directional pulleys 2.5 and connected to the linear spring 2.4. The other side of the spring 2.4 is connected with the wire 2.9 that is winded up to the pulley 2.2. FIG. 4 shows the actuator mechanisms for both directions. The actuators 2,3 use the series elastic actuation principle to apply a force to the vertical rod 1.2 and thereby to the vertical handle 4.

Figure 5:
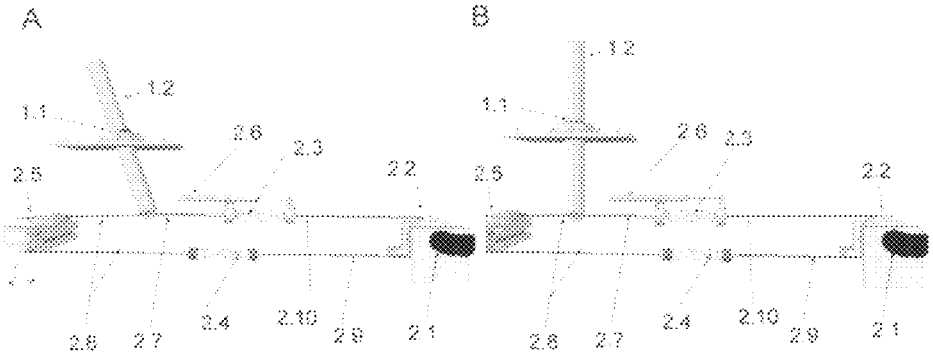
FIG. 5 shows the principle of vertical rod movement in a single direction.

FIG. 5A shows the principle of the vertical rod 1.2 movement in a single direction in spherical bearing 1.1. The wire 2.10 lead through the directional pulleys 2.5 is winded up by the electrical motor 2.1 driven pulley 2.2 and causes an extension of the linear spring 2.3 which is on the other side connected to the vertical rod 1.2 by the wire 2.7. The consequence is a rotation of the vertical rod 1.2 in spherical bearing 1.1. The recurrent wire 2.8 tension is regulated by the other linear spring 2.4 and the recurrent wire 2.9 that is adequately winded off the pulley 2.2. The extension of the linear spring 2.3 is measured by the linear potentiometer 2.6. FIG. 5B shows the initial position of the actuator system for single DOF.

Figure 6:
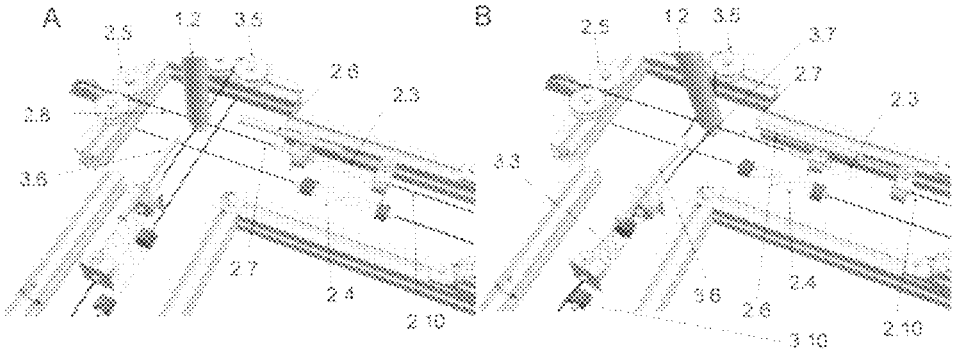
FIG. 6 shows the principle of vertical rod movement in both directions.
Figure 7:
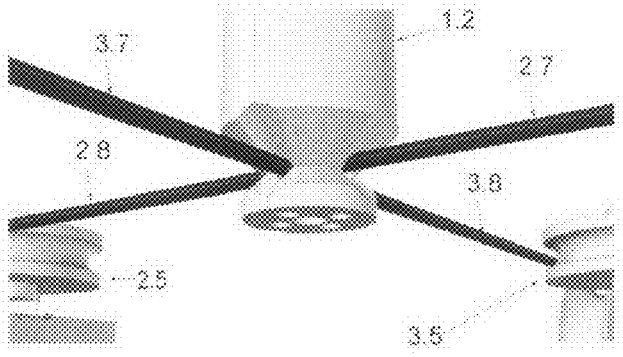
FIG. 7 shows how the wires of both actuators are connected to the vertical rod.
Figure 8:
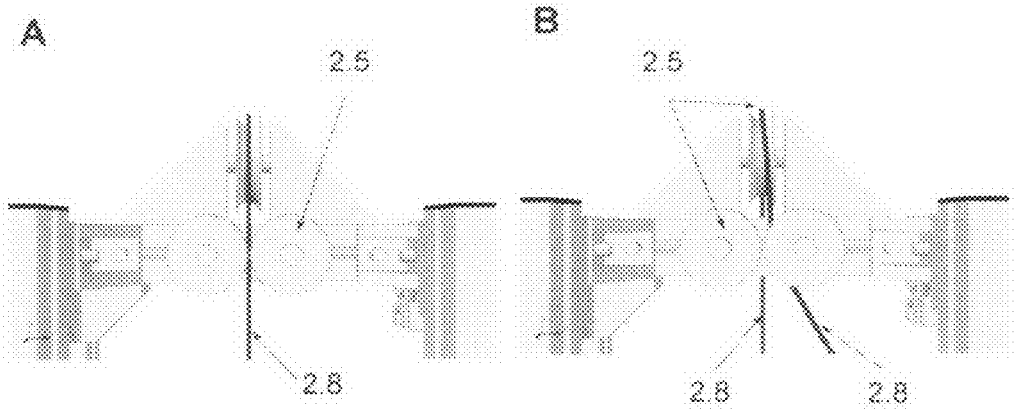
FIG. 8 shows the directional pulley of one of the actuators.

In FIG. 6A the initial position of the actuators 2,3 for both directions are shown. FIG. 6B shows the situation when both actuators actively cooperate to enable planar movement of the vertical rod 1.2. The wires 2.7,3.7,2.8,3.8 connected to the vertical rod 1.2 are put together almost in a single point as shown in FIG. 7. The directional pulleys 2.5,3.5 ensure that the recurrent wires 2.8,3.8 run smoothly irrespective of the vertical rod 1.2 angle as shown in FIGS. 8A and 8B.

Figure 9:
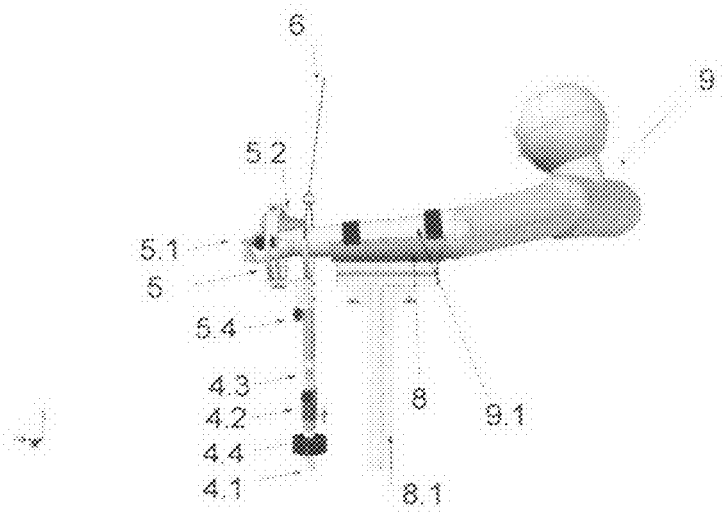
FIG. 9 shows the universal haptic drive system when used for wrist rehabilitation.
Figure 10:
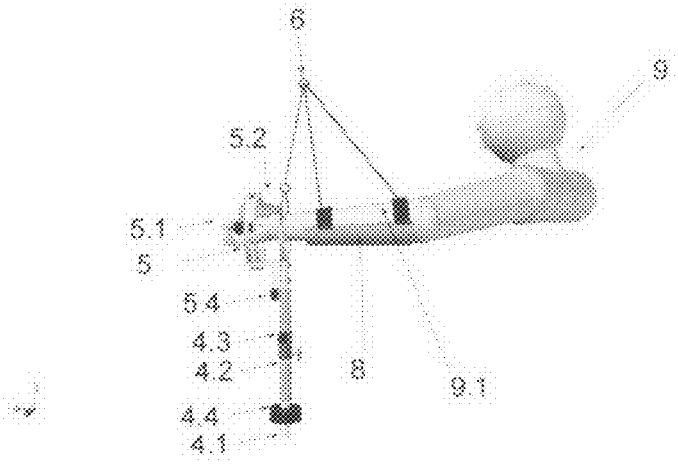
FIG. 10 shows the universal haptic drive system when used for arm rehabilitation.
Figure 11:
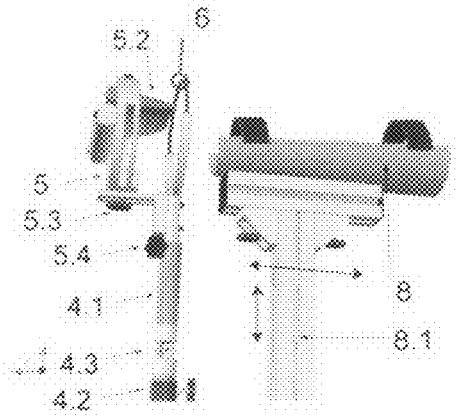
FIG. 11 shows the hand accessory fixed to the vertical handle.

The vertical handle 4 is inserted into the vertical rod 1.2 creating a passive linear joint and passive rotational joint in the connection point 4.1. The vertical handle 4 can be adjusted according to the user application (arm, wrist rehabilitation). The universal joint 4.3 enables 2 DOF movements, which are required for wrist rehabilitation as shown in FIG. 9. In this case the arm holder 8 with arm support 8.1 is installed in combination with the vertical handle 4 weight support 6 to compensate for the gravity. The arm rehabilitation requires a different setup. The universal joint 4.3 is locked with the brace 4.2, the weight support 6 mechanism is holding the vertical handle 4 and the arm holder 8, but no arm support 8.1 is required. This configuration is shown in FIG. 10. At the top of the vertical handle the hand accessory 5 is mounted. The hand accessory 5 is fixed to the vertical handle 4 with the screw 5.4, see FIG. 11. In this figure it is also shown how the height and the position of the arm holder 8 can be adjusted by different arm support 8.1 setups.

Figure 12:
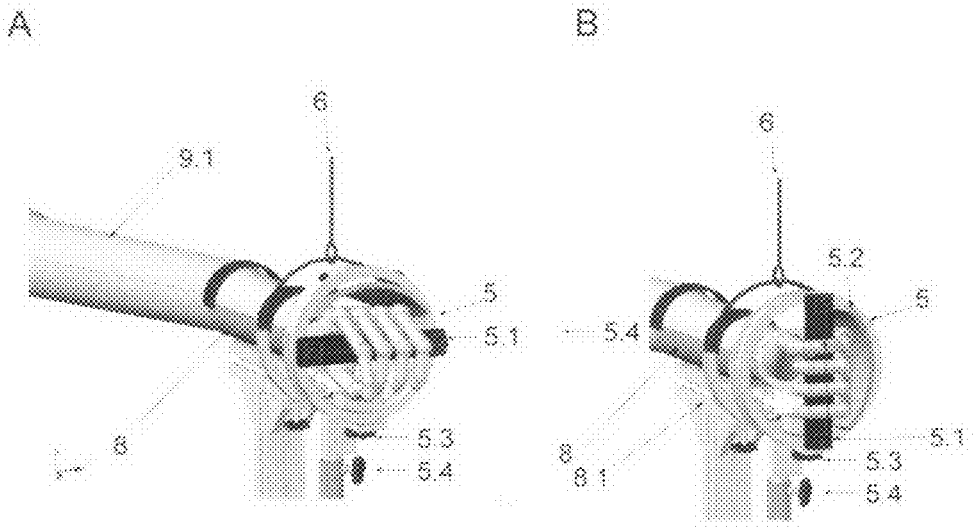
FIG. 12 shows how the hand grip position can be adjusted according to the specified task.

The hand grip 5.1 position can be adjusted according to the task specified. When the hand grip 5.1 is rotated to the desired configuration, the position can be locked by tightening the screw 5.3, as shown in FIGS. 12 A and 12 B.

Figure 13:
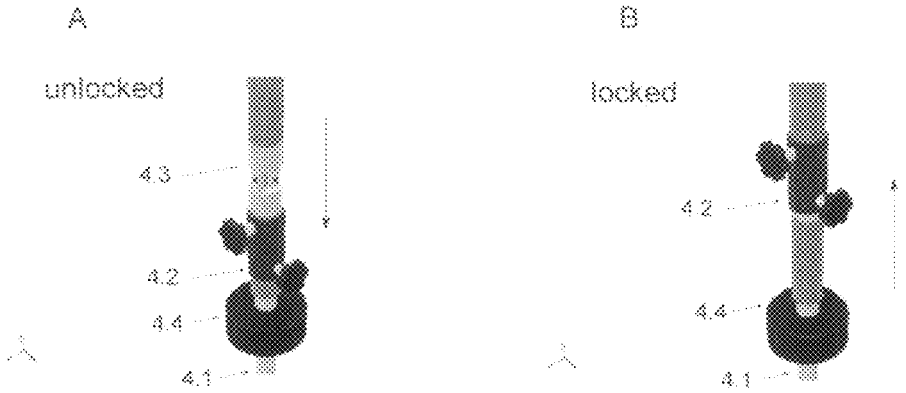
FIG. 13 shows the universal joint in an unlocked and locked state.

Now a functional description of the universal haptic drive system is given. FIG. 1 shows the possible application of the universal haptic drive system for hand or wrist treatment. According to the application type the aluminum brace 4.2 unlocks (see FIG. 13A) or locks (see FIG. 13B) the universal joint 4.3 on the vertical handle 4. Tightening the screws on the brace 4.2 causes a stiff vertical handle 4 suitable for arm rehabilitation.

Figure 14:
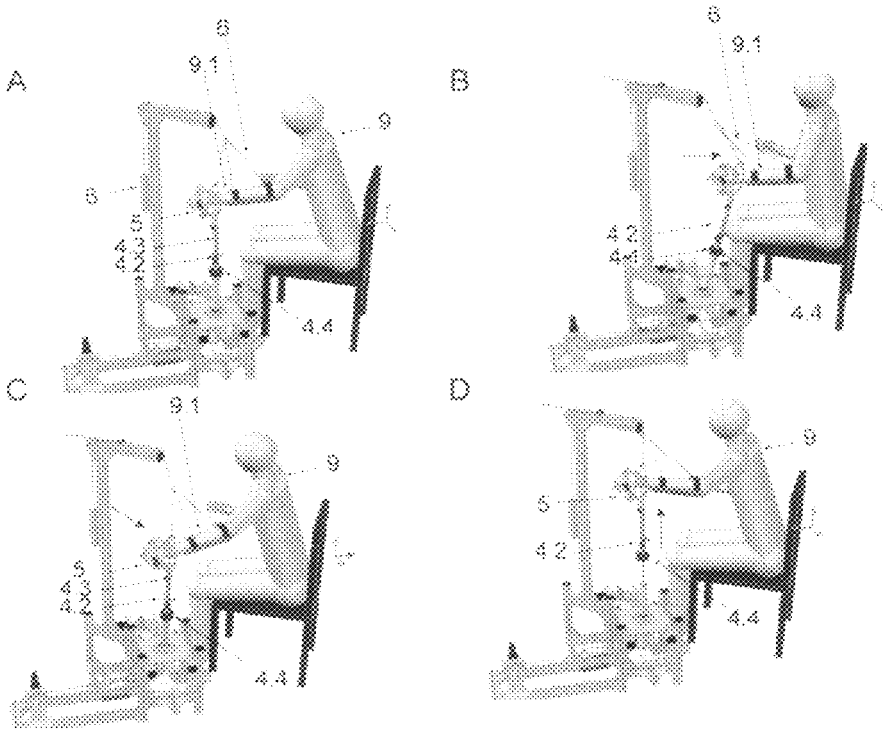
In FIG. 14 the arm movement training is demonstrated.

In FIG. 14 the arm movement training (for this application the universal joint 4.3 is locked) is shown. The subject 9 holds the arm in initial position as requested by the virtual task 7, therefore no haptic information in terms of force feedback is provided. When the subject moves the arm backward (FIG. 14B) to carry out the requested task, the universal haptic drive provides adequate force depending on the virtual task 7. The force applied by the subject is measured by the force sensor 4.4 installed in the vertical handle 4. The weight balance system 6 compensates for the gravity. In FIG. 14C the subject moves the arm to the left and in FIG. 14D upward.

Figure 15:
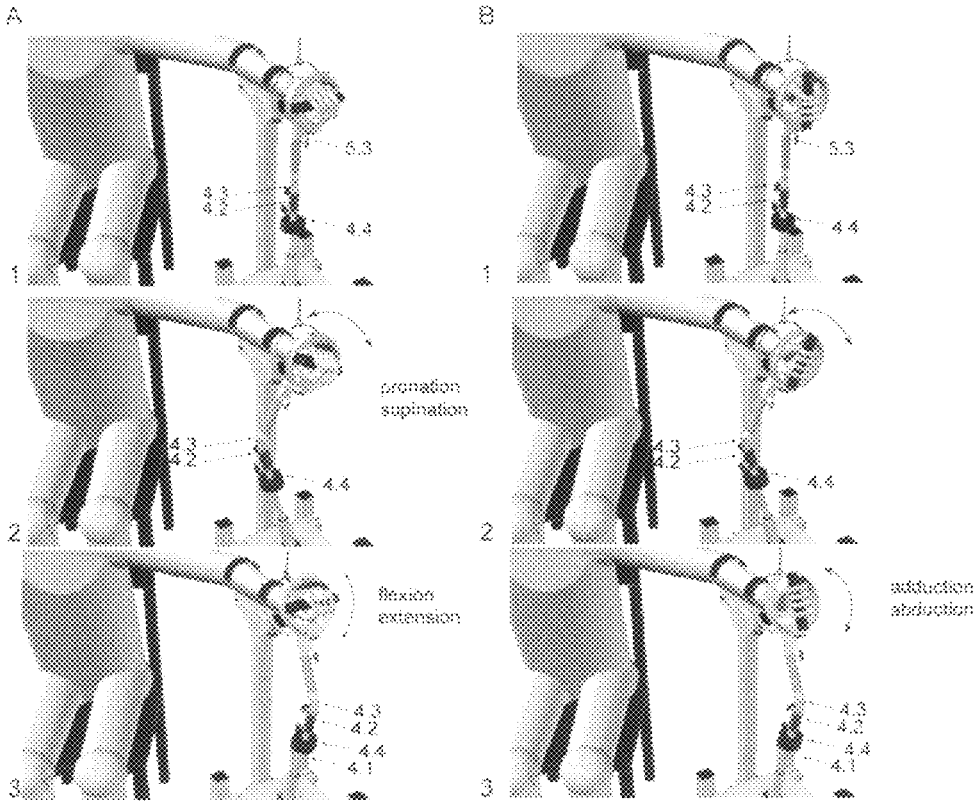
In FIG. 15 the wrist movement training is demonstrated.

In FIG. 15 the universal joint 4.3 is unlocked, enabling additional degrees of freedom needed for wrist movement training. FIG. 15A (left column) shows the hand grip 5.1 setup for the wrist flexion/extension (FIG. A3) or pronation/supination (FIG. A2), while FIG. 15B (right column) shows the hand grip (5.1) setup for wrist adduction (or ulnar flexion) and abduction (or radial flexion) (FIG. B3) or or pronation/supination (FIG. B2).

While the invention has been illustrated and described in detail in the drawings and foregoing description, such illustration and description are to be considered illustrative or exemplary and not restrictive; the invention is not limited to the disclosed embodiments.

For example, other ways of implementing the series elastic actuation principle than the one shown in FIGS. 3-6 may be envisaged by the skilled person.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

What is claimed is:

1. A universal haptic drive system for arm and wrist rehabilitation, comprising:

a hand accessory comprising a hand grip which is adjustable according to a specified task;

a substantially vertical handle connected to the hand accessory, the substantially vertical handle connected to a substantially vertical rod, and the substantially vertical rod is received in and extends through a bearing enabling the substantially vertical rod to rotate inside the bearing to enable the movement of the substantially vertical handle in the transversal plane with respect to the substantially vertical handle; and a wire-based haptic actuator system having two degrees of freedom and connected to an end of the substantially vertical rod to actuate the substantially vertical rod with two degrees of freedom and thereby apply a force to the substantially vertical handle and actuate the substantially vertical handle with two degrees of freedom; wherein the substantially vertical handle comprises a first section, a second section, a two degree of freedom universal joint, and a lock to lock the universal joint and render the universal joint inoperable, the first section being connected to the hand accessory at one end thereof and to the universal joint at an opposite end thereof, and the second section being connected to the substantially vertical rod at one end thereof and to the universal joint at an opposite end thereof;

the universal joint is in series with the haptic actuator system by a plurality of wires of the wire-based haptic actuator having two degrees of freedom;

when the universal joint is unlocked and operable, the first section and the second section are movable relative to one another to define a first workspace for the substantially vertical handle to provide two additional degrees of freedom actuated movements required for wrist rehabilitation movements, and when the universal joint is locked and inoperable, the first section and the second section are fixed relative to one another to inhibit the two additional degrees of freedom provided by the universal joint, thereby defining a second workspace for the substantially vertical handle which provides actuated movements with two degrees of freedom required for arm rehabilitation movements.

2. The system according to claim 1, wherein the the lock comprises a brace for locking and unlocking the universal joint.

3. The system according to claim 1, wherein the hand accessory comprises a grip that may be rotated relative to the substantially vertical handle, a hand shield and a component that disables rotation of the grip from a selected position.

4. The system according to claim 1, wherein the wire-based haptic actuator system uses a series elastic actuation principle to apply the force.

5. The system according to claim 1, wherein the wire-based haptic actuator system comprises a first wire-based actuator applying a force in a first direction in a substantially transversal plane, the first wire-based actuator comprising an electric motor and an elastic force transmission connected in series thereto, the substantially transversal plane being a plane having up to 20 degrees deviation with respect to a plane that is perpendicular to the vertical handle in an initial position.

6. The system according to claim 5, wherein the first wire based actuator further comprises a sensor that senses a force exercised by a subject, the sensor that senses the force detects the elongation of the elastic force transmission.

7. The system according to claim 6, wherein the sensor that senses the force is a linear potentiometer.

8. The system according to claim 5, wherein the first wire-based actuator further comprises an elastic body that regulates the tension of a recurrent wire.

9. The system according to claim 8, wherein the first wire-based actuator further comprises directional pulleys for ensuring smooth running of the recurrent wire.

10. The system according to claim 8, wherein the elastic body is a linear spring.

11. The system according to claim 5, wherein the first wire-based actuator further comprises a pulley mounted on the shaft of the electric motor to wind up a wire connected to the elastic force transmission means.

12. The system according to claim 5, wherein the wire-based haptic actuator system comprises a second wire-based actuator applying a force in a second direction perpendicular to the first direction.

13. The system according to claim 12, wherein wires of the wire-based actuator system are connected to the vertical rod in a single point.

14. The system according to claim 1, wherein the vertical handle comprises a force sensor.

15. The system according to claim 1, further comprising an arm holder and a weight support connected thereto.

16. The system according to claim 15, further comprising an arm support with different set-ups thereby adjusting the height of the arm holder.

* * * * *